United States Patent [19]

Reeve et al.

[11] 4,455,947

[45] Jun. 26, 1984

[54] COVERED HOPPER CAR

[75] Inventors: John C. Reeve, Lawrenceville; Howard C. Woodman, Roswell, both of Ga.

[73] Assignee: Portec, Inc., Oak Brook, Ill.

[21] Appl. No.: 340,849

[22] Filed: Jan. 20, 1982

[51] Int. Cl.[3] ..... B61D 7/00; B61D 17/16; B61D 39/00

[52] U.S. Cl. ..... 105/377; 52/45; 52/52; 52/56; 105/248; 105/418; 105/424

[58] Field of Search ..... 52/45, 47, 48, 49, 52, 52/56, 90, 249, 285; 220/80, 359; 105/247, 248, 358, 377, 424, 418

[56] References Cited

U.S. PATENT DOCUMENTS

| | | | |
|---|---|---|---|
| 2,225,170 | 12/1940 | Gilpin | 52/56 X |
| 2,235,937 | 3/1941 | Linberg | 220/80 X |
| 3,442,225 | 5/1969 | Mowall-Larsson | 52/45 X |
| 3,664,270 | 5/1972 | Stark et al. | 105/377 |
| 4,227,354 | 10/1980 | McNally et al. | 52/52 |
| 4,275,662 | 6/1981 | Adler et al. | 52/56 |
| 4,377,058 | 3/1983 | Hallam et al. | 105/377 |

*Primary Examiner*—Robert B. Reeves
*Assistant Examiner*—Howard Beltran
*Attorney, Agent, or Firm*—Emory L. Groff, Jr.

[57] ABSTRACT

A railway hopper car includes an angular roof having a roof sheet provided with lateral edges each connected to the top of the car side sheet by an elongated top chord. Each top chord includes a substantially rectangularly-sectioned tube member affixed to the exterior of the top portion of the side sheet and includes a top wall inclined inwardly and upwardly and projecting interiorly of the car beyond the top edge of the side sheet. The undersurface of the lateral portion of the roof sheet overlies and is attached to a substantial portion of the upper surface of the top chord top wall. An inside wall on each top chord comprises a vertical member terminating in a top edge abutting the inclined top wall to provide a smooth vertical plane readily admitting installation of the side sheets and subsequent car interior lining.

2 Claims, 2 Drawing Figures

COVERED HOPPER CAR

This invention relates generally to covered railway hopper cars and more particularly to an improved top chord for a hopper car having an angular roof.

Covered hopper cars are provided with either flat, angular or curved roof sheets. In the case of an angular roof car, the roof comprises a sheet inclined downwardly and outwardly from the car centerline and having its opposite lateral edges extending to the area adjacent the top of the car side sheets. Structure must be provided to adequately attach and support the compnents of the car in this area and usually comprises a chord member or beam extending the length of the car. Such a top chord should provide sufficient rigidity to the car body without interferring with the handling of bulk lading and preferably facilitates the installation of an appropriate lining on the interior of the car to protect the car components from caustic or otherwise deleterious lading.

Many prior top chord assemblies in covered hopper cars have included beams or angles presenting an exposed shelf or ledge located on the exterior and/or the interior of the car, which arrangement produces a catch basin serving to collect lading residue respectively, upon the loading of the car or discharge of its lading. This earlier structure obviously produces several disadvantages. If spilled lading is allowed to remain collected upon the top chord, this lading residue is wasted and subsequently contaminates the right of way during transit of the car. Additionally, certain existing top chords are configured or so located as to preclude or interfer with the ready installation of a lining within the car interior.

The use of a rectangular tube section for top chords on covered hopper cars has long been recognized for its inherent advantages which includes superior section properties along all axes for any given weight. Such chords may be produced to straighter limits and readily accommodate attachment of car side posts. On the other hand, this type of chord configuration has been found to exhibit shortcomings. The conventional rectangular top chord presents four radius-configured corners and the inside, top-most corner, will be understood to form with the overlying roof sheet, a cavity or void within the car interior. This leads to difficulty in welding the top chord roof sheet and necessitates bending the lateral edge of the roof sheet to overlie the horizontal top wall of the top chord. Furthermore, the cavity serves as a trap for certain commodities carried in the car and interferes with the application of a car interior lining.

By the present invention, an improved arrangement is provided wherein a particularly configured top chord comprises a generally rectangular member of tube section formed of an integral shaped stock having an inclined top wall flushly engaging the undersurface of the roof sheet, and a vertical inside wall flush with the side sheet and abutting an intermediate portion of the chord top wall.

Accordingly, one of the objects of the present invention is to provide an improved curved roof hopper car having a top chord joining each roof sheet lateral edge to a side sheet with the top chord including a four-sided tube member having a vertical wall attached to the outer face of a side sheet and a top wall flush with the roof sheet and extending inwardly of the plane of the vertical wall.

Another object of the present invention is to provide an improved covered hopper car including a top chord joining the interior surface of a roof sheet to the exterior surface of an adjacent side sheet, with the assembly providing adjacent structural components discouraging entrainment of lading within the car and readily accommodating an interior lining.

A further object of the present invention is to provide an improved covered hopper car having an angular roof sheet including a top chord joining adjacent edges of the roof sheet and side sheets and provided with parallel outside and inside walls normal to a bottom wall, with an inclined top wall underlying the roof sheet and projecting inwardly beyond the inside wall.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawing.

Figure 1:
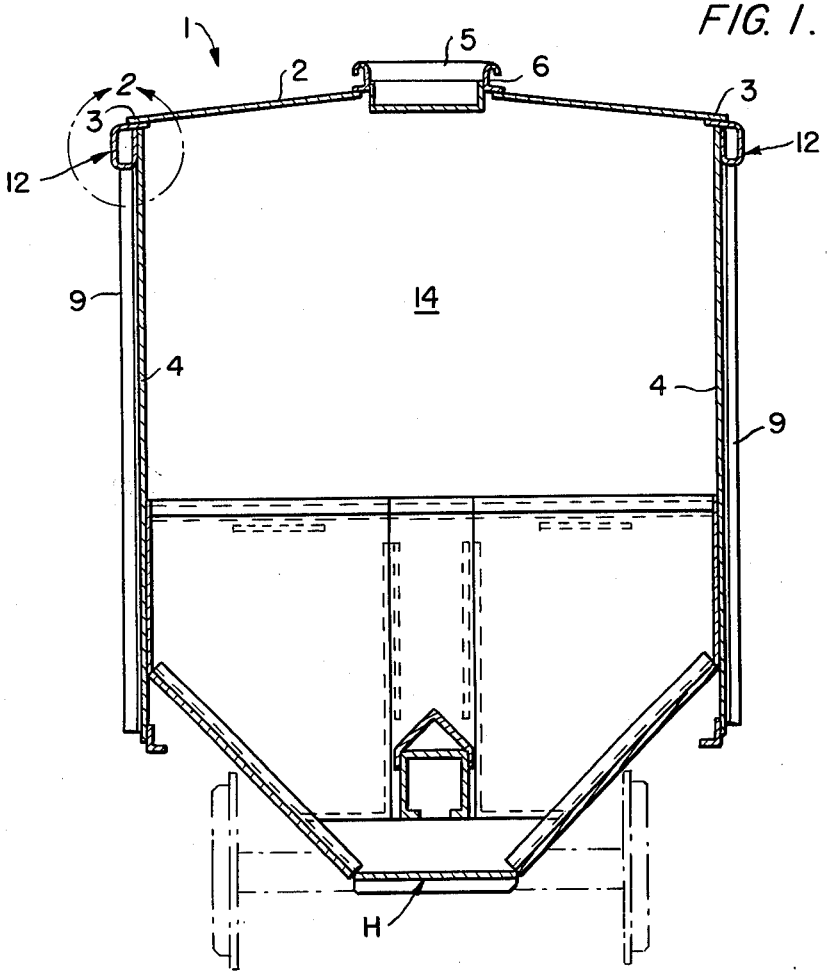
FIG. 1 is a transverse sectional view through a typical covered hopper car and illustrates the top chord assembly of the invention.

Referring now to the drawing, particularly FIG. 1, the present invention will be seen to relate to a covered hopper car generally designated 1. The lowest point of the car body will be understood to include an appropriate hopper arrangement of any suitable construction in the area H. The roof preferably comprises an angular roof sheet 2 expanding the top of the car 1 and provided with two longitudinally extending parallel lateral edges 3-3 each projecting outwardly beyond the vertical plane defined by one of the two vertical side sheets 4-4. A plurality of hatch openings 5 are provided along the car centerline through the roof sheet 2, each including well known coaming 6. With this arrangement, the hatch openings 5 are disposed at the highest point of the car, a feature common to all covered hopper cars. However, the above construction when employing the top chord of the present invention, will be seen hereinafter to yield a vastly improved car assembly.

Figure 2:
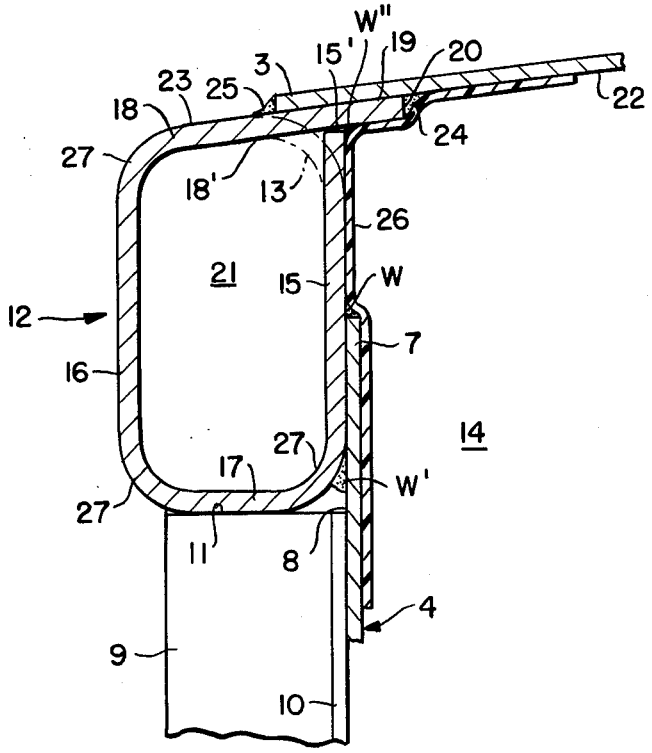
FIG. 2 is an enlarged fragmentary sectional view of the encircled area 2 of FIG. 1, with the inclusion of an optional interior lining.

As shown most clearly in FIG. 2 of the drawing, each side sheet 4 preferably comprises a vertical planar member having a horizontally disposed top portion 7 located at a point substantially below the plane of the roof sheet lateral edge 3. The outer face 8 of the side sheets are suitably reinforced by means of a plurality of vertically disposed, laterally spaced apart side posts 9 which may comprise any well known configuration such as channel members having opposite flanges 10 affixed to the side sheet outer faces 8. The top portion 7 of each side sheet preferably extends substantially above the top 11 of the side posts and terminates along a line spaced beneath the roof sheet 2 and inwardly of its lateral edge 3 as shown in FIG. 2.

A top chord, generally designated 12 is employed to provide both the required rigidity in the area adjacent each car side sheet and roof lateral edge and also to form a substantially smooth vertically extending internal profile between the joined roof sheet and side sheets. This top chord 12 comprises a unitary structural member extending substantially the length of the car and includes a modified or generally rectangular tube member offering an improvement over the more conventional or regular rectangular configuration reflected by the broken lines 13 in FIG. 2. If such a conventional rectangular tube were used in the illustrated car 1, it would be obvious that a less stable and inaccurate provision will exist for accomplishing welding of the roof sheet to the top chord and the lateral edge 3 of the roof sheet would have to be bent into a horizontal plane in order to flushly engage a flat top wall on the top chord. Additionally, the resultant generally triangular cavity formed between the roof sheet and top chord would impede the application of an interior lining and/or serve as a trap discouraging full discharge of lading from with the car interior 14.

The top chord 12 comprises a unitary structural element including a vertical planar inside wall 15 parallel to a vertically disposed outside wall 16 with both of these walls normal to and joined by a horizontally disposed bottom wall 17. The generally rectangular configuration of the top chord is completed by a top wall 18 which extends inwardly from the upper portion of the outside wall 16 and includes a terminal portion 19 having a free edge 20 disposed within the interior 14 of the car. This chord top wall 18 will be understood to comprise a planar element inclined upwardly and inwardly from the outside wall 16 at an angle substantially comparable to the disposition of the angular roof sheet 2. The inside wall 15 includes a top edge 15' which extends upwardly to abut the bottom surface 18' of the top wall 18 at a point inwardly of its terminal portion 19 and is suitably secured thereto such as by the fillet weld W'' so as to fully enclose the interior of the top chord to provide a cavity 21 therein.

During installation or assembly of the top chord 12, the top 11 of the side posts will be understood to be appropriately affixed to the top chord bottom wall 17 while the inside wall 15 of the chord is welded or otherwise secured to the outer face 8 of the side sheet as at W'. The roof sheet is disposed in a flush overlying manner with its undersurface 22 atop the upper surface 23 of the top chord top wall 18 and with the lateral edge 3 extending outwardly beyond the vertical plane of the chord inside wall 15. Thereafter suitable fillet wells 24 and 25 integrate the car roof sheet with the assembled top chord and side sheet.

With the above described installation in mind, it will be seen that a clean vertical disposition is presented within the interior 14 of the car which readily lends itself to the subsequent application of a car interior lining 26. This lining may comprise any suitable substance such as one of many well know plastic compositions which are most readily applied by spraying so as to overlie all surfaces exposed to the interior 14 of the car.

From the foregoing, it will be appreciated that an improved top chord is presented and which offers a departure from the more conventional regular rectangular configuration. The top chord 12 includes three vertical or horizontal walls 15, 16 and 17 adjacent three relatively large radius corners 27 while a fourth inclined top wall 18 extends inwardly and upwardly past the top edge 15' of one inside wall to complete an enclosed integral chord member.

We claim:

1. A covered hopper car including, substantially vertically disposed side sheets each having a top portion, a roof sheet provided with centrally disposed hatch openings, said roof sheet extending outwardly and downwardly from said hatch openings and having opposite lateral edges spaced above and adjacent said side sheet top portions, a single member top chord spanning each spaced apart side sheet and roof sheet edge, each said top chord comprising an inside wall joined to one said side sheet top portion, a bottom wall connected to said inside wall, an outside wall extending upwardly from said bottom wall, a planar top wall connected to said outside wall and inclined inwardly and upwardly to provide a planar upper surface, said top wall having a free edge disposed within the car interior beyond the vertical plane of said chord inside wall and said side sheet, said roof sheet comprising a planar member disposed at an inclination comparable to the inclination of said planar top chord top wall, said top chord comprising a tube member formed of unitary stock having three rounded corners and defining a closed internal cavity, vertical side posts joined to said side sheets and abutting said top chord bottom walls, said side posts fully disposed beneath said top chord bottom walls, said roof sheet having a planar undersurface, said roof sheet lateral edge substantially overlying said top chord top wall upper surface with a portion of said undersurface flushly engaging said chord top wall upper surface, and a disparate lining of plastics composition covering the interior of said roof sheet, top chord and side sheet.

2. A covered hopper car according to claim 1 wherein, said side sheet top portion terminates along a line spaced substantially below said top chord top wall.

* * * * *